US005237767A

United States Patent [19]

Kringel et al.

[11] Patent Number: 5,237,767

[45] Date of Patent: Aug. 24, 1993

[54] MOUNTING DEVICE

[75] Inventors: George Kringel, Westport; James E. Richardson, Weston, both of Conn.

[73] Assignee: ActMedia, Norwalk, Conn.

[21] Appl. No.: 970,603

[22] Filed: Oct. 29, 1992

Related U.S. Application Data

[63] Continuation of Ser. No. 698,260, May 6, 1991, abandoned, which is a continuation of Ser. No. 311,837, Feb. 17, 1989, abandoned.

[51] Int. Cl.[5] ..... G09F 3/18

[52] U.S. Cl. ..... 40/642; 40/652; 40/658; 248/231.4

[58] Field of Search ..... 40/642, 651, 611, 666, 40/652, 653, 649, 658; 248/74.4, 231.6, 316.6, 229, 231.4; 29/325, 335, 459, 527, 528; 211/74; 312/234.4; 81/128, 142-149; 269/210

[56] References Cited

U.S. PATENT DOCUMENTS

| | | | |
|---|---|---|---|
| 104,606 | 6/1870 | Lebeau | 269/210 |
| 540,252 | 6/1895 | Harding | 24/528 |
| 561,151 | 6/1896 | Andrianse | 269/210 |
| 612,316 | 10/1898 | Downes . | |
| 755,384 | 3/1904 | Palmer . | |
| 1,082,112 | 12/1913 | Cutler . | |
| 1,637,305 | 7/1927 | Hendsch . | |
| 1,666,079 | 4/1928 | Anderson | 269/210 |
| 1,704,562 | 3/1929 | Egan | 40/652 |
| 1,884,971 | 10/1932 | Galbraith . | |
| 2,062,156 | 11/1936 | Zerbst | 248/229 X |
| 2,094,051 | 9/1937 | Zakos | 40/658 X |
| 2,218,581 | 10/1940 | Levan | 220/24.5 |
| 2,364,477 | 12/1944 | Sayles et al. | 248/228 |
| 2,529,686 | 11/1950 | Green | 248/231.4 X |
| 2,859,546 | 11/1958 | Gutterson | 40/10 |
| 2,914,980 | 12/1959 | Flaig | 81/128 |
| 3,015,897 | 1/1962 | Hopp | 40/11 |
| 3,148,699 | 9/1964 | Umanoff | 40/5 |
| 3,313,054 | 4/1967 | Madey | 40/10 |
| 3,429,539 | 2/1969 | Lucietto | 248/228 |
| 3,510,923 | 5/1970 | Blake | 24/528 |
| 3,530,605 | 9/1970 | Gutterson | 40/11 |
| 3,714,724 | 2/1973 | Slavsky | 40/11 |
| 3,728,806 | 4/1973 | Kostiuk | 40/11 R |
| 3,765,633 | 10/1973 | Claudill | 248/229 |
| 3,797,143 | 3/1974 | Miller | 40/10 R |
| 3,899,841 | 8/1975 | Berger | 40/11 |
| 3,939,986 | 2/1976 | Pierro | 248/231.4 |
| 3,941,028 | 3/1976 | Lobello | 35/73 |
| 3,949,880 | 4/1976 | Fortunato | 248/231.7 X |
| 4,016,977 | 4/1977 | Krautsack | 206/526 |
| 4,373,693 | 2/1983 | Greenberger | 248/221.4 |
| 4,420,082 | 12/1983 | Bernie | 206/526 |
| 4,466,592 | 8/1984 | Janson | 248/225.1 |
| 4,537,310 | 8/1985 | Thal | 206/326 |
| 4,541,598 | 9/1985 | Villanueva | 248/221.4 |
| 4,556,183 | 12/1985 | Greenberger | 248/221.4 |
| 4,572,380 | 2/1986 | Langwell | 211/57.1 |
| 4,646,452 | 3/1987 | Mazzucchelli | 40/299 |

FOREIGN PATENT DOCUMENTS 627993 3/1936 Fed. Rep. of Germany .

*Primary Examiner*—Kenneth J. Dorner
*Assistant Examiner*—Brian K. Green
*Attorney, Agent, or Firm*—Patrick J. Coyne; Kenneth M. Massaroni; James Juo

[57] ABSTRACT

A mounting device is provided for attaching promotional displays, dispensers, or other objects to a shelf in a grocery or other retail store shelf. The mounting device has resilient first and second jaws that are forced into engagement with the shelf by a locking slide. In one preferred embodiment, first jaw and second jaw are oriented at slightly less a 90° angle relative to the body of the mounting device. The body has a vertical slot into which a rack attached to the second jaw slides and a horizontal channel into which a locking slide is inserted to cooperate with the rack. The rack has teeth which mesh with cooperating teeth on a locking slide to move the jaws together. In addition, the body has, for example a price channel, to which an advertising or promotional display device such as a shelftalker, or other object can be mounted.

19 Claims, 5 Drawing Sheets

MOUNTING DEVICE

This application is a continuation of application Ser. No. 07/698,260 filed on May 6, 1991, which is a continuation of application Ser. No. 07/311,837 on Feb. 17, 1989, now abandoned.

BACKGROUND OF THE INVENTION

The present invention relates to a mounting device for mounting objects on the edge of a shelf or other surface. The mounting device of the present invention can be used to mount a variety of objects on a surface and is specifically adapted to mount advertising or promotional materials, a coupon dispenser, an advertising card display holder (commonly referred to as a "shelftalker"), or other display device on a shelf in a grocery or other retail store Certain mounting devices for attaching an object to a surface are well known. Mounting devices are available in the form of clamps, brackets, fittings, etc. Many mounting devices that have been used previously, however, are not suitable for mounting all types of advertising and promotional materials or other display devices on a grocery or other retail store shelf.

Shelves in grocery and other retail stores typically have a channel attached to the distal edge of the shelf. These channels are generally referred to as "price channels." Price channels are typically formed of extruded metal sections, such as an extruded aluminum section. Price channels are adapted to accept cards that display price, weight, or other product information. Price channels have also been used to mount advertising and promotional materials on grocery or other retail store shelves.

The configuration and dimensions of price channels in common use in grocery and other retail stores vary widely. Moreover, certain shelving and other display spaces are not equipped with price channels at all. Typically, shelf mounted, in-store advertising devices (shelftalkers) are mounted in the price channel. Shelftalkers are typically equipped with mounting hardware that will allow the shelftalker to be mounted in price channels having a range of sizes and configurations. Nonetheless, it is either difficult or impossible to use this standard mounting hardware in mounting locations that either lack price channels entirely or have price channels that are two narrow, too wide, or of different configuration relative to the mounting hardware on the shelftalker. In these situations, it is necessary to employ some type of mounting adaptor that will connect the shelftalker or other advertising or product information materials to the shelf or other desired mounting point.

Mounting adaptors that have been used to mount shelftalkers, other promotional materials, or product information in locations that are not equipped with price channels typically employ either clamps, brackets, or adhesives. Some of these mounting devices which have been used in the past clamp onto the upper and lower surfaces of the mounting surface adjacent the edge. Clamps that have been used previously for this purpose typically have multiple mechanical parts, may be bulky, and may have elements or parts that extend away from the body of the mounting device a substantial distance. In that these clamps tend to be large, the mounting device takes up valuable display space. Many of these mounting devices have elements or parts that extend away from the body of the mounting device which tend to detract from the overall appearance of the installation and may obstruct access to the adjoining shelf space or to products displayed on the shelf. Moreover, the customer may bump into these parts or elements or snag clothing or jewelry on them.

Brackets and adhesives mounting devices tend to be more compact, yet, share other disadvantages with the types of clamps that have been used prior to the present invention. Brackets may be attached permanently to the shelf or other mounting surface, typically by screws of other fasteners. While adhesive panels may not require permanent mounting, both brackets and adhesive panels can be fixed in one location and cannot readily be moved from one location to another as desired, such as when the mounting device is desired to be used to promote a product in a different location.

Moreover, many mounting devices known prior tot he present invention are unable to withstand rough usage to which a mounting device may be subject in a grocery or other retail store. In-store promotional programs may require that the mounting device remain in place in a store for periods of months at a time, or longer. During that period, the display material and mounting device may be repeatedly bumped and manipulated. Unless the mounting device is resilient and durable, it may not be able to withstand even accidental abuse and remain in place on the shelf for the full duration of the promotional program.

Many mounting devices that have been used prior to the present invention may not provide a firm and secure, yet easily detachable mounting. Clamp type devices can be readily removed. Similarly, adhesive mountings can be peeled off of the surface to which they are mounted with relatively little force, or if more substantial force is required for removal, the adhesive may damage the mounting surface. While brackets may be more permanent, often they too can be removed relatively easily and are not readily moveable to other locations. Moreover, installation and removal of brackets can damage or mar the shelf or other mounting surface.

Further, mounting devices mounted on the distal edges of grocery or other retail store shelves are readily accessible and are frequently subject to vandalism or intentional abuse. It is not uncommon for children, or others, to pull on the advertising display or to hang from it, thereby, placing substantial force on the mounting device. In addition, persons having access to the display may mutilate it or its mounting. Many mounting devices that have been used prior to the present invention cannot withstand such abuse.

In addition, mounting devices used in promotional programs in retail stores should be easy to install and should be detachable. Frequently, at the end of a promotional campaign for a particular product, the display must be moved to another location in the store or to another store for use in another promotional campaign. In view of the temporary nature of many advertising or promotional campaigns, a mounting device adapted for mounting advertising or promotional materials on a shelf must be relatively inexpensive and must be easy to install. It is also desirable that the mounting device be detachable and reusable.

Accordingly, there is a need for an easy to use mounting device that will provide a means for attaching dispensers, shelftalkers, other advertising and promotional materials or displays, or other objects to a shelf or other mounting surface that is attractive, inexpensive, easy to install, detachable, and provides a sound and compact attachment. Moreover, such a device must be resilient and must be able to withstand rough usage, including being bumped, vandalized, and tampered with. Prior art approaches do not adequately address the problem of providing such a mounting device.

OBJECTS OF THE INVENTION

The primary object of the present invention, therefore, is to provide a device for mounting objects including, but not limited to, shelftalkers, advertising and promotional materials, dispensers, or other display devices on a shelf or other mounting surface.

A further object of the present invention is to provide an inexpensive mounting device.

Another object of the present invention is to provide a mounting device that is easy to install.

An additional object of the present invention is to provide a mounting device that is detachable and reusable.

Yet a further object of the present invention is to provide a compact and attractive mounting device.

A further object of the present invention is to provide a mounting device that is secure.

Another object of the present invention is to provide a durable, resilient, and easily maintained mounting device that will withstand severe usage conditions and accidental or intentional abuse.

Additional objects and advantages of the invention are set forth, in part, in the description which follows and, in part, will be obvious from the description or may be learned by practice of the invention. The objects and advantages of the invention will be realized in detail by means of the instrumentalities and combinations particularly pointed out in the appended claims.

SUMMARY OF THE INVENTION

The present invention overcomes the disadvantages of the prior art and attains the objects of the invention by providing a mounting adaptor device for attaching objects, for example, coupon dispensers, shelftalkers, other advertising or promotional materials, or other devices, to a shelf or other mounting surface, such as in a grocery or other retail store. The present invention provides a firm, durable, and resilient attachment to a shelf or other mounting surface. It provides a mounting surface for attaching other objects to the mounting device once it is installed. Similarly, the present invention provides a compact and attractive, yet, inexpensive mounting device. Moreover, the present invention provides an easy to install, detachable, and reusable mounting device.

To achieve the objects, and in accordance with the purpose of the invention, as embodied and broadly described herein, the invention is a mounting device for detachably fixing, relative to a mounting surface, attachment means for mounting an object, comprising: first jaw means having, a body and, a first jaw disposed in non-parallel relation to said body, said body having a slot formed therein, said slot oriented in non-parallel relation to said first jaw, a channel formed therein, said channel oriented in non-parallel relation to said slot, and attachment means for connecting the object to said body; second jaw means having a rack, a second jaw disposed in non-parallel relation to said rack, said rack having a plurality of first teeth; and locking slide means for cooperating with said channel, said locking slide means having one or more second teeth for cooperating with said first teeth to force said first and second jaws into engagement with the mounting surface as said locking slide is inserted into said channel.

It is to be understood that both the foregoing general description and the following detailed description are exemplary and explanatory only and are not restrictive of the invention as claimed.

The accompanying drawings, which are incorporated herein by reference and constitute a part of this specification, illustrate one embodiment of the invention, and together with the description, serve to explain the principles of the invention.

Figure 1:
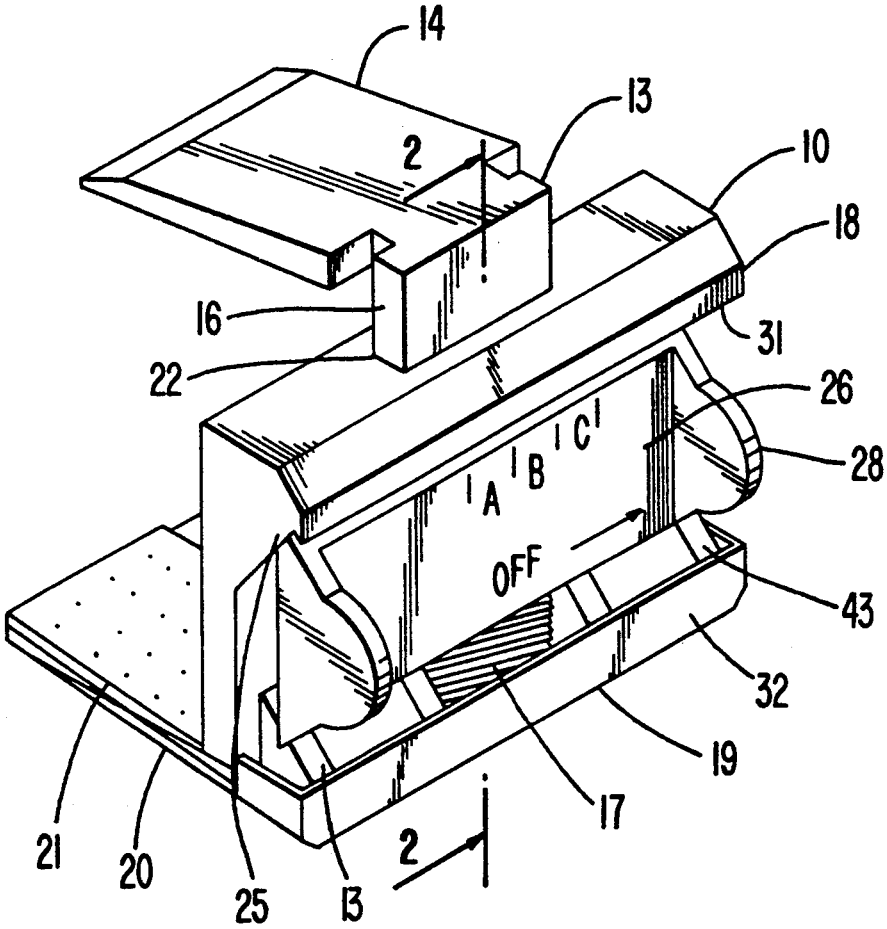
FIG. 1 is a perspective view of a preferred embodiment of the mounting device of the invention.
Figure 2:
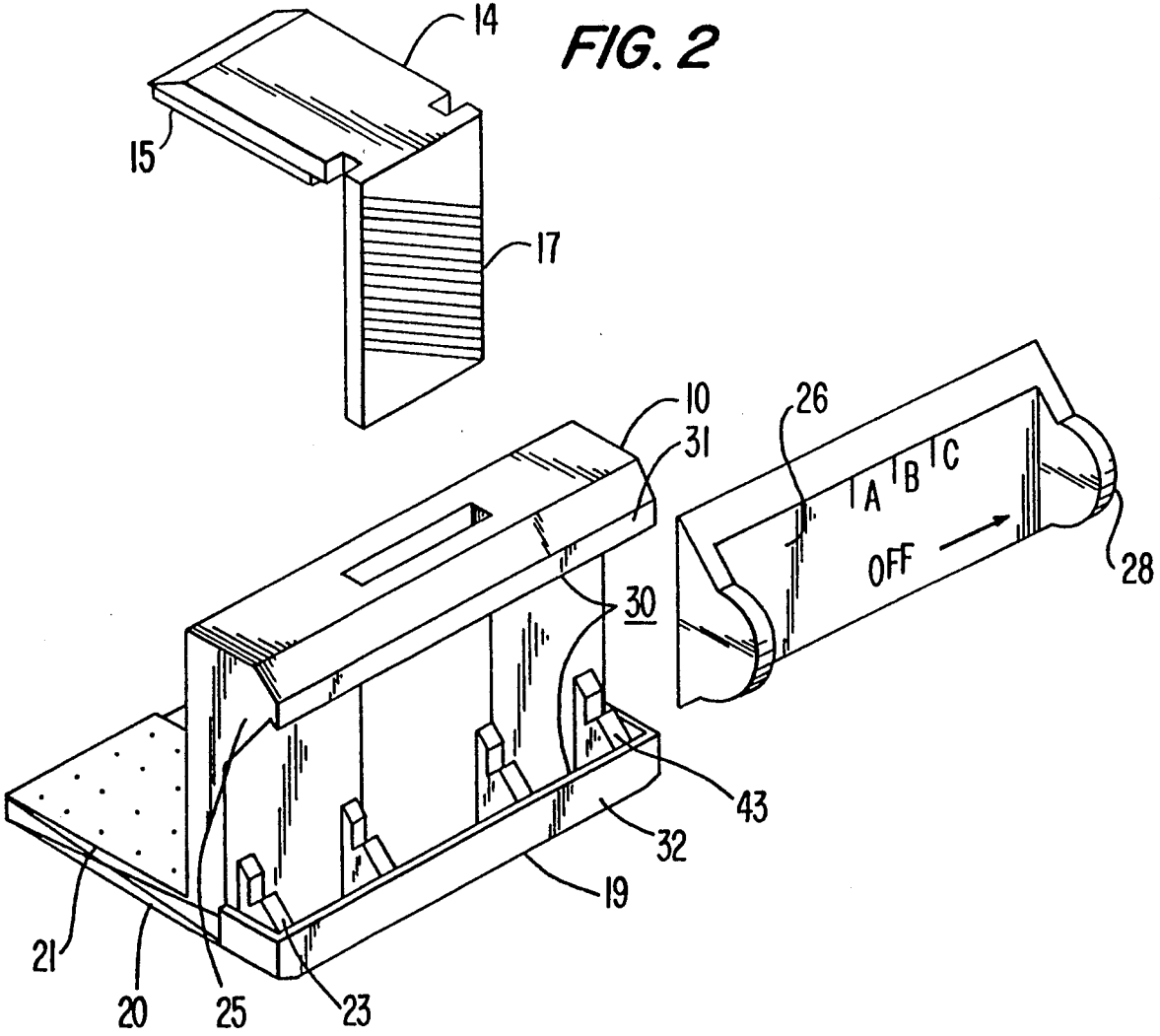
FIG. 2 is an exploded perspective view of the mounting device shown in FIG. 1, along section 2—2.
Figure 3:
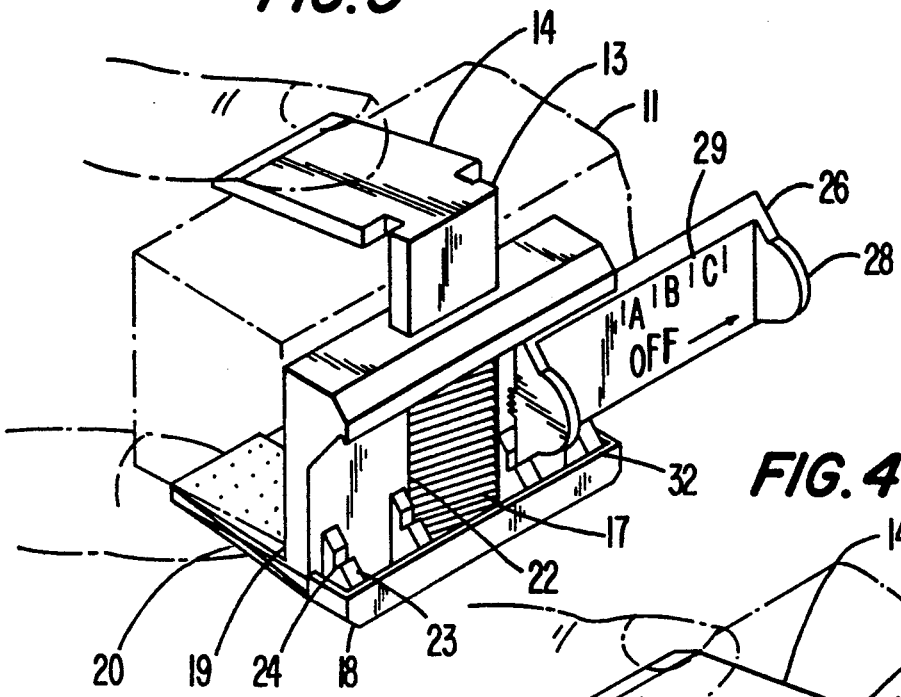
FIG. 3 is a perspective view of a preferred embodiment of the mounting device of FIG. 1, shown as it is being installed.
Figure 4:
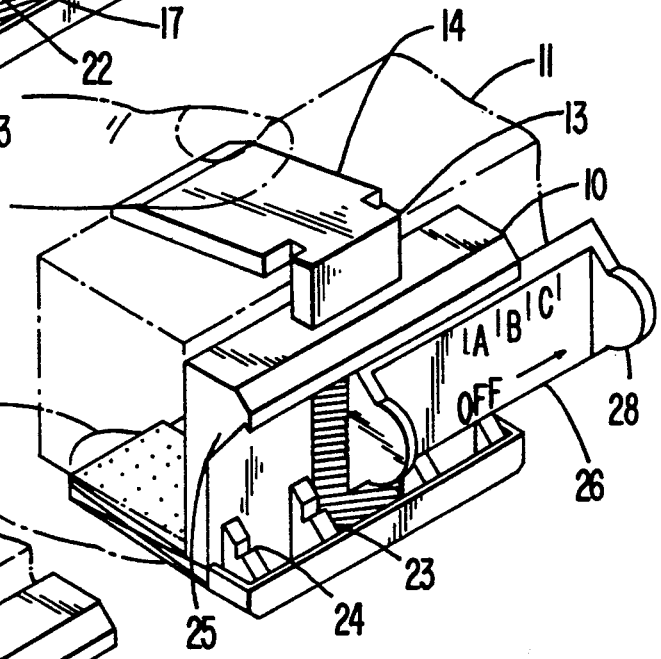
FIG. 4 is a perspective view of a preferred embodiment of the mounting device of FIG. 1, shown during installation as the jaws of the mounting device are closed around the mounting surface.
Figure 5:
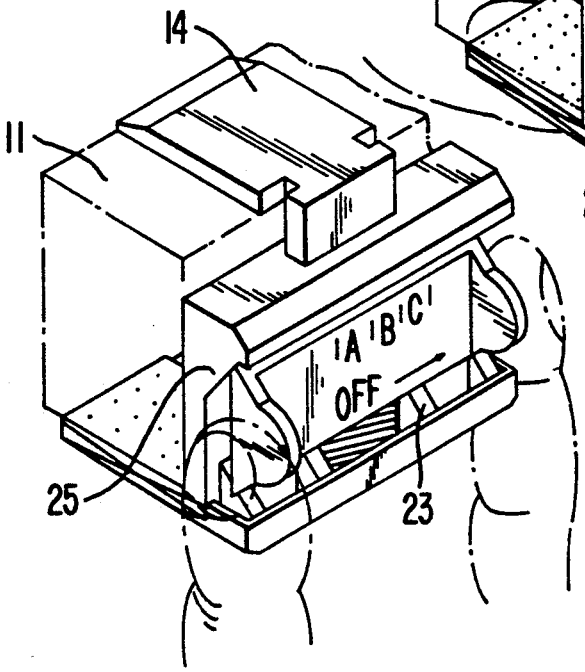
FIG. 5 is a perspective view of a preferred embodiment of the mounting device of FIG. 1, shown during installation as the device is fully mounted.
Figure 6:
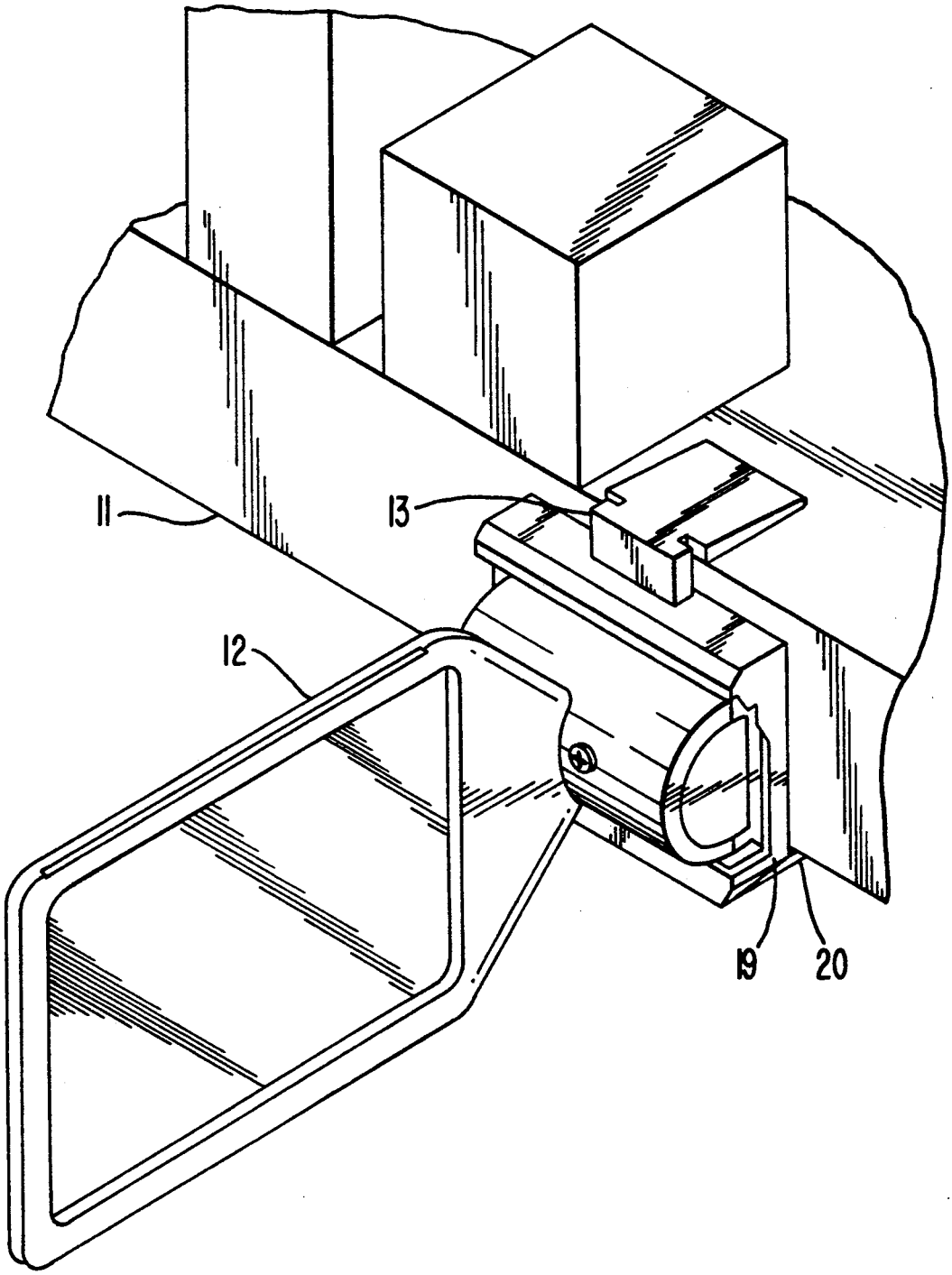
FIG. 6 is an perspective view of the mounting device of FIG. 1 in mounted relation to a shelf in a grocery store.
Figure 7A:
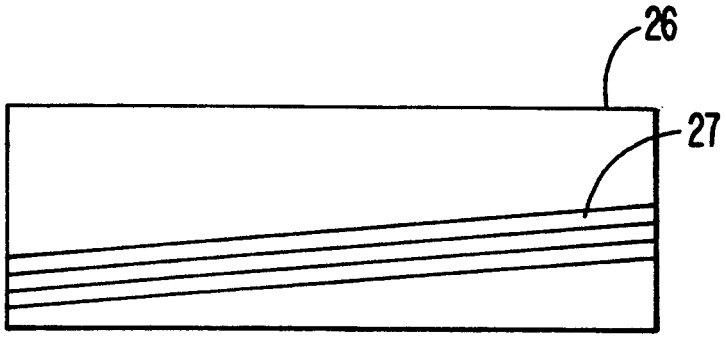
Figure 7B:
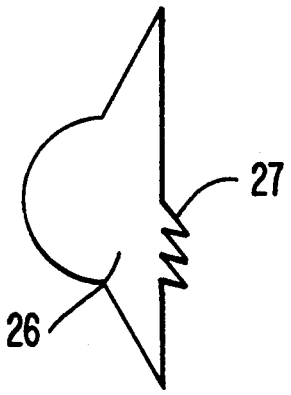

FIGS. *7a* and *7b* are a reverse angle view and a side view, respectively of a preferred embodiment of the slide of the mounting device shown in FIG. 1.

FIG. *7a* is a reverse angle view of slide 26 of the mounting device shown in FIG. 1.

FIG. *7b* is a side view of slide 26 of the mounting device shown in FIG. 1.

DESCRIPTION OF THE PREFERRED EMBODIMENT

Reference will now be made in detail to a present preferred embodiment of the invention, an example of which is illustrated in the accompanying drawings. A preferred embodiment of the invention is shown in FIG. 1 as 10.

In accordance with the invention, mounting device 10 cooperates with shelf or other mounting surface 11 to provide an attachment point for object 12, to hold object 12 firmly and resiliently in place on mounting surface 11. Object 12 can be any object that is desired to be mounted on the edge of mounting surface 11, such as a shelf, table top, or other surface. In a preferred embodiment of the present invention, mounting surface 11 is a shelf or other surface in a grocery or other retail store suitable for mounting advertising and promotional display devices. Object 12 can be an advertising and promotional display device or materials, a shelftalker, a product display rack or other product display device, product or pricing information cards, or other appropriate materials.

It will be apparent to those skilled in the art that various modifications and variations can be made in the construction of mounting device 10 of the present invention, without departing from the scope or spirit of the invention. For example, mounting surface 11 could assume a variety of shapes and configurations while performing the function of providing a mounting surface for object 12. Mounting surface 11 could be a vertical surface, as well as horizontal, or could be oriented at some intermediate angle. Moreover, mounting surface 11 could be of irregular shape, provided substantially opposing surfaces are available for mounting. Similarly, object 12 could comprise a variety of objects. For example, object 12 could be a lamp, a stand, a holder, as well as the types of advertising and promotional devices and materials disclosed in conjunction with the detailed description of a preferred embodiment of the invention. Hence, it is intended that the present invention cover the modifications and variations of the invention, provided they come within the scope of the appended claims and their equivalents.

In accordance with the present invention, mounting device 10 has first jaw means 18, second jaw means 13, and locking slide means 26. Second jaw means 13 is adapted to fit into slot 22 in the body of first jaw means 18, and is held in place by locking slide 26.

In a preferred embodiment of the present invention, second jaw means 13, is preferably constructed out of a resilient plastic material, such as ABS plastic, or other suitable material having similar resilient properties. In a preferred embodiment of the invention, second jaw means 13 has a second jaw 14, pad 15, and rack 16. Second jaw 14 is disposed at an angle of slightly less than 90° relative to rack 16. Pad 15 is mounted on the surface of second jaw 14 proximal to mounting surface 11, so that when mounting device 10 is installed on shelf 11, pad 15 contacts the upper surface of shelf 11. In a preferred embodiment of the present invention, rack 16 has a substantially planar surface distal from mounting surface 11. The distal surface of rack 16 has first teeth 17 formed therein. First teeth 17 are disposed at an angle relative to the horizontal axis of mounting device 10 and mounting surface 11.

In a preferred embodiment of the present invention, first jaw means 18 is preferably constructed out of resilient plastic material, such ABS plastic, or other suitable material having similar resilient properties. As embodied herein, first jaw means 18 has first jaw 20 which, in a preferred embodiment of the present invention, has body 19, first jaw 20, and pad 21. First jaw 20 is disposed at an angle of slightly less than 90° relative to body 19. Pad 21 is mounted on the surface of first jaw 20 proximal to mounting surface 11, so that when mounting device 10 is installed on shelf 11, pad 21 contacts the underside of shelf 11.

In a preferred embodiment of the present invention, body 19 has a substantially vertical slot 22 formed therein for receiving rack 16 of second jaw means 13, so that first teeth 17 are accessible through the surface of body 19, distal from shelf 11. Body 19 also has a plurality of retainers 23. Retainers 23 form channel 24 at a substantially right angle relative to slot 22. Channel 24 is open on one end of body 19 and has stop 25 on the opposite end of body 19.

Mounting device 10 has a locking slide 26, which is preferably constructed out of a resilient plastic material, such as ABS plastic, or other suitable material having similar resilient properties. In a preferred embodiment of the present invention, locking slide 26 has second teeth 27 and handle 28. Second teeth 27 are disposed on the surface of locking slide 26, proximal to mounting surface 11. Second teeth 27 are oriented at an angle relative to the horizontal axis of mounting device 10. One or more handles 28 are disposed on the rear surface of locking slide 26 distal from mounting surface 11. In a preferred embodiment of the invention, locking slide 26 is adapted to cooperate with retainers 23. As embodied herein, locking slide 26 is inserted into channel 24 formed by retainers 23 so that second teeth 27 cooperate with first teeth 17 on rack 16. First teeth 17 and second teeth 27 mate with first teeth 17. As locking 26 slide is inserted into channel 24 until locking slide 26 abuts stop 25, second teeth 27 cooperate with first teeth 17 to move second jaw means 13 relative to first jaw means 18.

As embodied herein, second jaw 14 and first jaw 20 are made of resilient material, so that they are deformable under the clamping forces developed by the mounting device of the present invention 10. Moreover, in a preferred embodiment of the present invention second 14 and first 20 jaws are oriented converging slightly toward their distal ends. As locking slide 26 is inserted into channel 24, the distal ends of second 14 and first 20 jaws, respectively, are brought into contact with mounting surface 11. As progressively greater clamping forces are developed by mounting device 10, and are transmitted to second 14 and first 20 jaws, greater force is applied to the distal ends of jaws 14 and 20, holding them firmly in place relative to mounting surface 11. As second 14 and first 20 jaws are subjected to progressively greater clamping forces, second 14 and first 20 jaws deform so that progressively greater surface area of jaws 14 and 20 respectively contacts mounting surface 11, thereby distributing the greater clamping force over a more substantial area of mounting surface 11 and providing firm attachment of mounting device 10 without placing undue or potentially damaging levels of force on a limited area of mounting surface 11.

It will be apparent to those skilled in the art that various modifications and variations can be made in the construction of second jaw means 13 and first jaw means 18 of the present invention without departing from the scope or spirit of the invention. For example, first jaw means 18 could also comprise a body and a second movable jaw, so that the body would retain locking slide 26 and both jaws would move relative to body 19. Similarly, slot 22, retainers 23, and channel 24 could assume a variety of shapes, configurations, and orientations while performing the function of holding second jaw means 13 relative to first jaw means 18 and facilitating mating of first 17 and second 27 teeth. Hence, it is intended that the present invention cover the modifications and variations of the invention, provided they come within the scope of the appended claims and their equivalents.

In a preferred embodiment of the present invention, locking slide 26 has index 29, which serves to indicate the degree of force that will be developed as locking slide 26 is fully inserted into channel 24. The distance locking slide 26 is allowed to travel with first 17 and second 27 teeth engaged, and first jaw 20 and second jaw 14 engaged with mounting surface 11, determines the degree of clamping force developed by mounting device 10.

As embodied herein, mounting device 10 is oriented in the desired position relative to shelf 11 and locking slide 26 is inserted partially into channel 24, so that it is engaged under retainers 23 on only the proximal side of channel 24 and does not span slot 22. Index 29 is aligned with the first retainer 23, at the opening of channel 24. As first jaw 20 and second jaw 14 are forced together under finger pressure, retainers 23 allow first teeth 17 of rack 16 to slide past second teeth 27 of locking slide 26 unless locking slide 26 is engaged against retainers on both sides of slot 22. Finger pressure is applied to the outer surface of first and second jaws 20 and 14 to force first teeth 17 past second teeth 27 until second 14 and first 20 jaws are engaged against mounting surface 11. First teeth 17 and second teeth 27 are oriented to permit such movement in one direction only. Locking slide 26 is then fully inserted into channel 24, under distal retainers 23, until locking slide 26 hits stop 25. This point serves as a home position for locking slide 26.

In a preferred embodiment of the present invention, index 29 has three markings: "A," "B," and "C." Depending on which marking was aligned with first retainer 43, greater or lesser distance of travel of locking slide 26 will be available, resulting in greater or lesser clamping forces being applied by mounting adaptor device 10 to mounting surface 11. In a preferred embodiment of the present invention, first and second jaw means 18 and 13 comprise resilient material. By virtue of their orientation, converging toward their distal ends, mounting device 10 exhibits a spring-like property which allows the lock slide 26 to be driven fully to its lower position under a variety of loading conditions.

In a preferred embodiment of the invention, mounting device 10 has attachment means 30. As embodied herein, attachment means 30 comprises a price channel. Price channel 30 has upper lip 31 and lower lip 32 formed in body 19 of mounting adaptor device 10. As embodied herein, object 12 is adapted to cooperate with price channel 30. For example, object 12 could be a shelftalker which is equipped with standard mounting hardware for mounting to a price channel of a grocery or other retail store shelf.

A shelftalker 12 suitable for mounting on a grocery or other retail store shelf by means of mounting device 10 of the present invention is disclosed in applicants' copending application for Advertising Display Mounting Device. Application Ser. No. 704,835, a continuation of application Ser. No. 311,743. Further, mounting device 10 of the present invention could be used in conjunction with other advertising display devices such as a coupon dispenser device.

In a preferred embodiment of the invention, attachment means 30 provides a secure mounting that is resistant to tampering. Specifically, the cooperating mounting hardware of object 12 will typically have a housing or shroud that fits over attachment means 30 and the distal portion of mounting device 10 to prevent locking slide 26 from being removed from channel 24, while object 12 is engaged in attachment means 30.

It will be apparent to those skilled in the art that various modifications and variations can be made in first jaw means 18, second jaw means 13, locking slide 26, and attachment means 30 of the present invention without departing from the scope or spirit of the invention. Hence it is intended that the present invention cover the modifications and variations of the invention, provided they come within the scope of the appended claims and their equivalents.

I claim:

1. A mounting device for detachably affixing a display to a mounting surface, comprising:

first jaw means having:

a body and a first jaw having a substantially planar gripping surface extending away from said body, said body having;

a slot formed therein, said slot oriented in substantially non-parallel relation to the planar surface of said first jaw, a channel formed therein, said channel oriented to enable movement therealong in a direction substantially non-parallel to said slot, and an attachment means comprising a price channel for mounting the display on said body;

second jaw means having:

a rack having a plurality of first teeth;

a second jaw having a planar gripping surface extending away from said rack and disposed in substantially non-parallel relation to said rack;

substantially planar slide means, adapted to be moved along said channel, for cooperating with said channel, said substantially planar slide means having second teeth for cooperating with said first teeth to force said first and second jaws into engagement with, or to release said first and second jaws from engagement, with the mounting surface as said slide means is moved along said channel; and wherein said first jaw means and said second jaw means are engaged with the mounting surface by moving said substantially planar slide means in said channel and said first jaw means and said second jaw means are disengaged from the mounting surface by moving said substantially planar slide means in an opposite direction in said channel.

2. The mounting device of claim 1, wherein said surface is a shelf.

3. The mounting device of claim 1, wherein said display device is a shelftalker.

4. The mounting device of claim 1, wherein said first and second jaws have resilience for their engagement with the surface.

5. The mounting device of claim 1, wherein the planar gripping surface of said first and second jaws comprise distal and proximate ends, said first and second jaws being inclined at an angle relative to the surface such that the distal ends of said first and second jaws are in closer proximity to the surface than the proximal ends of said first and second jaws, and wherein their resilience enables them to deform as increasing gripping pressure is applied to said first and second jaws to allow progressively greater areas of the planar surfaces of said first and second jaws to engage the mounting surface.

6. The mounting device of claim 1 wherein said first jaw is located on one side of said body and wherein said first teeth are disposed on an opposite side of said body and wherein said slide means is mounted on said one side.

7. A mounting device for detachably affixing a display to a surface, comprising:

a first jaw having a body and a substantially planar first jaw element, disposed at an acute angle relative to said body, said body having:

a slot formed therein, said slot being oriented to extend away from said first jaw element in substantially non-parallel relation to said first jaw element, a channel formed therein, said channel oriented in substantially parallel relation to said first jaw element, and an attachment means comprising a price channel means for affixing the display on said body, said attachment means being located distally from said first jaw element;

a second jaw having:

a rack, a substantially planar second jaw element located on one side of said rack and disposed at an acute angle relative to said rack;

said rack having first teeth disposed on an opposite side of said rack;

a substantially planar locking slide, adapted to be moved in said channel, said substantially planar locking slide having second teeth disposed on the surface of said substantially planar locking slide adjacent said first teeth for cooperating with said first teeth to force said first and second jaw elements into engagement with the mounting surface or release therefrom as said substantially planar locking slide is moved in said channel; and wherein said first and second jaws are engaged with the surface by moving said substantially planar locking slide means in said channel and said first and second jaws are disengaged from the surface by moving said substantially planar locking slide means in the opposite direction in said channel.

8. The mounting device of claim 7, wherein said object is a shelftalker.

9. The mounting device of claim 7, wherein said first and second jaw elements have resilience for their engagement with the mounting surface.

10. The mounting device of claim 7, wherein said first and second jaw elements are normally inclined at an angle relative to the surface and wherein their resilience enables them to deform as increasing gripping pressure is applied to the mounting device to allow progressively greater areas of said first and second jaws to engage the surface.

11. A mounting device for detachably fixing, relative to a shelf, a section of a price channel for mounting a shelftalker on the edge of a shelf, comprising:

a fixed jaw having:

a body and a first jaw, having a substantially planar gripping surface disposed at an acute angle relative to said body, said body having:

a slot formed therein, said slot being oriented in substantially perpendicular relation to said first jaw, a channel formed therein, said channel being disposed in substantially perpendicular relation to said slot, a section of a price channel, oriented on said body for mounting the shelftalker on said mounting device;

a movable jaw having:

a rack, a second jaw having a substantially planar gripping surface disposed at an acute angle relative to said rack, and substantially parallel to the planar gripping surface of said fixed jaw, said rack having first teeth disposed on one side surface of said rack;

a substantially planar locking slide adapted to move along said channel, said locking slide having second teeth, for cooperating with said first teeth to force said fixed and movable jaws into engagement with the mounting surface or release therefrom as said locking slide is moved along said channel; and wherein fixed and moveable jaws are engaged with the shelf by moving said substantially planar locking slide means in said channel and said fixed and moveable jaws are disengaged from the shelf by moving said substantially planar locking slide means in the opposite direction in said channel.

12. The mounting device of claim 11, wherein said fixed and movable jaws have resilience for their engagement with the mounting surface.

13. The mounting device of claim 11, wherein the planar gripping surfaces of said fixed and movable jaws are normally inclined at an angle relative to the mounting surface and wherein their resilience enables them to deform as increasing gripping pressure is applied to the mounting device so as to allow progressively greater areas planar gripping surfaces of said first and second jaws to engage the mounting surface.

14. A mounting device for removable attaching an object to a structure, comprising:

first means and second means being adapted to engage the structure;

said first means comprising a body having:

a price channel formed therein for connecting the object to said mounting device, a slot formed therein to receive said second means, and a channel formed therein;

said second means comprising a rack having a plurality of first teeth disposed on one side of said rack;

substantially planar slide means, adapted to move in said channel, and comprising second teeth, said substantially planar slide means cooperating with said channel to develop a mechanical advantage in association with said first teeth force said first means and said second means into engagement with the structure over a substantial range of movement of said slide means in said channel;

wherein said second teeth cooperate with said first teeth to prevent reversal of the direction of movement of said first means from said second means unless the direction of movement of said substantially planar slide is also reversed;

wherein said first and second means are engaged with the structure by moving said substantially planar slide means in said channel and said first and second means are disengaged from the structure by reversing the direction of movement of said substantially planar slide means in said channel.

15. The mounting device of claim 14, wherein said object is an advertising display device.

16. The mounting device of claim 14, wherein said object is a shelftalker.

17. The mounting device of claim 14, wherein said first means further comprises a resilient first gripping means and said second means further comprises a second gripping means to prevent slippage and facilitate adhesion to both smooth and irregular surfaces.

18. The mounting device of claim 17, wherein said first gripping means and said second gripping means cooperate to engage the structure in gripping engagement.

19. The mounting device of claim 14, wherein said slide means develops sufficient mechanical advantage to securely yet removably affix said first and second means relative to the structure.

* * * * *